United States Patent [19]

Klaver et al.

[11] 4,123,208

[45] Oct. 31, 1978

[54] DRY SPINNING PACK ASSEMBLY

[75] Inventors: Petrus Klaver, Waynesboro, Va.; Jacob G. Steenhof de Jong, Giessenburg, Netherlands

[73] Assignee: E. I. Du Pont de Nemours and Company, Wilmington, Del.

[21] Appl. No.: 783,454

[22] Filed: Mar. 31, 1977

[51] Int. Cl.[2] ..... B29F 3/08

[52] U.S. Cl. ..... 425/72 S; 264/176 F; 425/382.2; 425/404; 425/464

[58] Field of Search ..... 264/204, 176 F; 425/72 R, 72 S, 378 S, 404, 379 S, 445, 382.2, 464, 463

[56] References Cited

U.S. PATENT DOCUMENTS

| | | | |
|---|---|---|---|
| 3,271,818 | 9/1966 | Bryan | 425/72 S |
| 3,737,508 | 6/1973 | Weir | 425/72 S X |
| 3,976,411 | 8/1976 | Rahlfs et al. | 425/72 R |

FOREIGN PATENT DOCUMENTS

| | | | |
|---|---|---|---|
| 27,561 | 12/1967 | Japan | 425/72 S |

*Primary Examiner*—Francis S. Husar
*Assistant Examiner*—Mark Rosenbaum

[57] ABSTRACT

An improved apparatus for dry spinning of filaments adapted to minimize the occurrence of oversized filaments during spinning. The apparatus includes a spinning pack positioned in a chamber supplied with heated gas. The spinning pack includes a distribution plate provided with a plurality of radial passages for gas, each passage having an opening at one end located at the periphery of the pack and an opening at the other end located at the bottom of the pack at the center of the extruded filament bundle to distribute heated gas from the outer chamber to the center of the filament bundle.

3 Claims, 5 Drawing Figures

DRY SPINNING PACK ASSEMBLY

BACKGROUND OF THE INVENTION

This invention relates to apparatus for the dry spinning of filaments. More particularly, it relates to apparatus for spinning acrylic filaments with provision for distributing heated gas to the outside of the filament bundle and to the center of the filament bundle from the outside heated gas source.

In the manufacture of acrylic fibers by the dry spinning process, a solution of the acrylonitrile polymer in a volatile, inert organic solvent is pumped through a spinning pack and extruded through the spinneret orifices as a multiplicity of streams. A heated gas, comprising an inert gas hotter than the solution, is impinged against the extruded streams to evaporate part of the solvent, reducing the solvent content from about 60–75% to about 20–30% and forming filaments of the polymer. Conventionally, the orifices are arranged in concentric rings around a blank central portion of the bottom surface of the spinneret of the spinning pack.

For increased spinning productivity, it is desired to spin as many filaments simultaneously as possible. One limitation to productivity is distribution of the heated gas uniformly through the filaments.

SUMMARY OF THE INVENTION

In accordance with this invention, an improvement is provided in the conventional apparatus for the dry spinning of filaments of synthetic polymers. The conventional apparatus comprises a dry spinning cell that includes a spinning pack located in a chamber supplied with heated gas for impinging against filaments extruded from the bottom surface of the spinning pack in concentric rings surrounding a blank central portion of said bottom surface. In the improved apparatus, the spinning pack is provided with a passage connecting the peripheral surface of the pack which is exposed to the heated gas to the central portion of the bottom surface to provide a flow passage for the gas from the chamber to the center of the rings of filaments.

DETAILED DESCRIPTION OF THE PREFERRED EMBODIMENT

Figure 1:
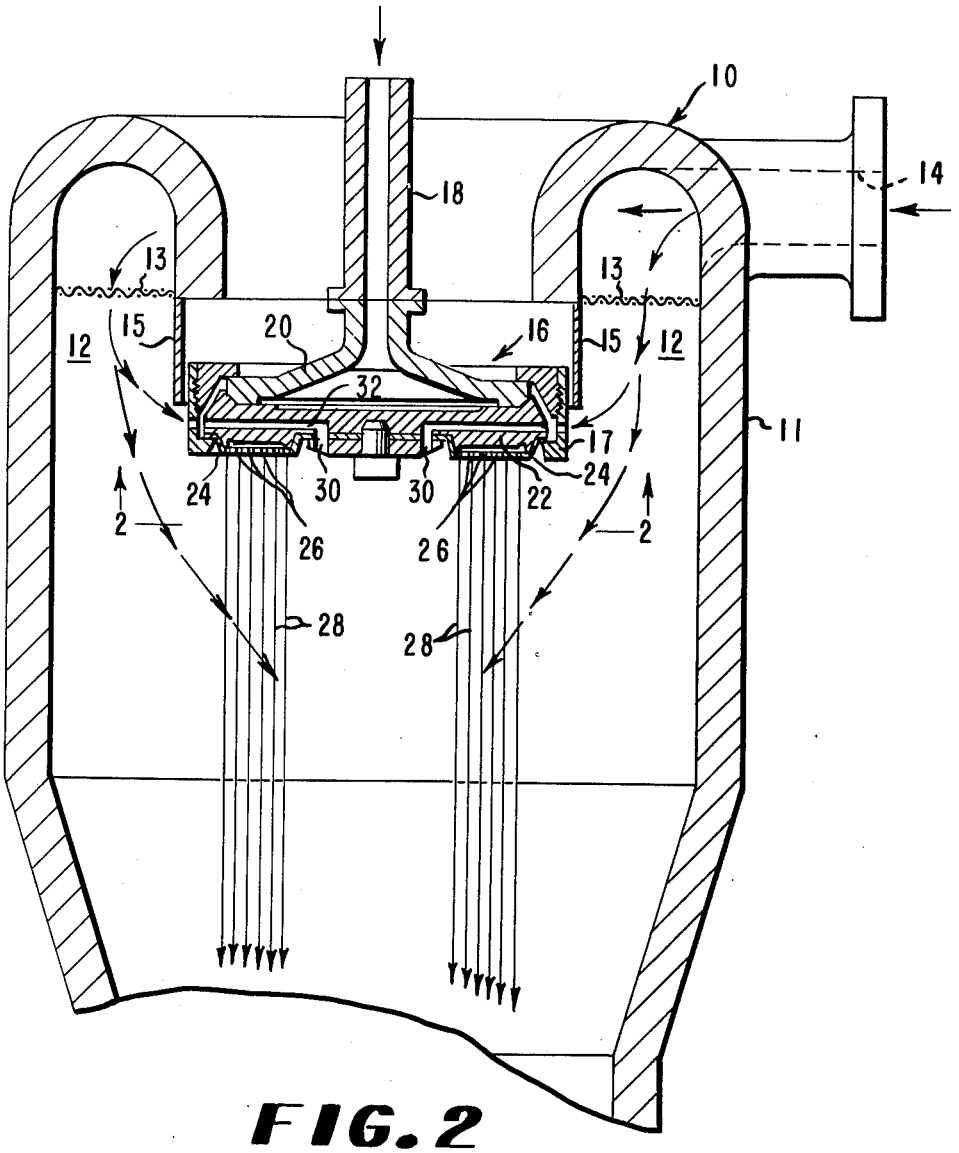
FIG. 1 is a diagrammatic sectional elevation view of the apparatus of the invention, showing the spinning pack mounted within a chamber supplied with heated gas.
Figure 2:
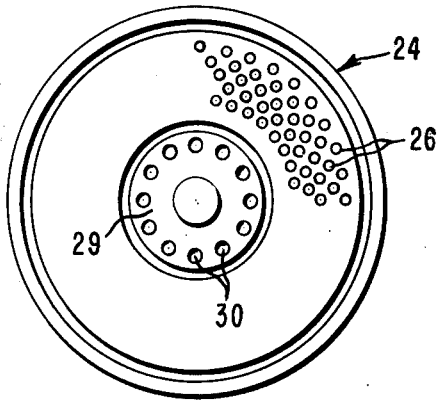
FIG. 2 is a bottom view of the spinning pack taken along line 2—2 of FIG. 1.
Figure 3:
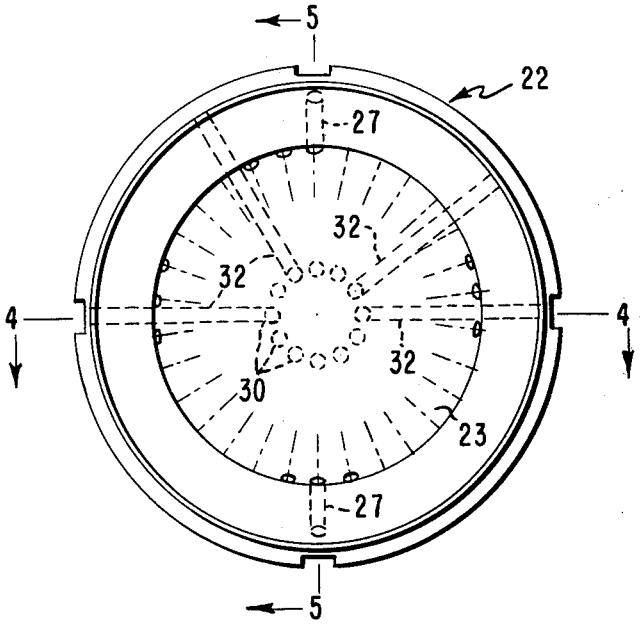
FIG. 3 is a plan view of the distribution plate which forms a part of the spinning pack.
Figure 4:
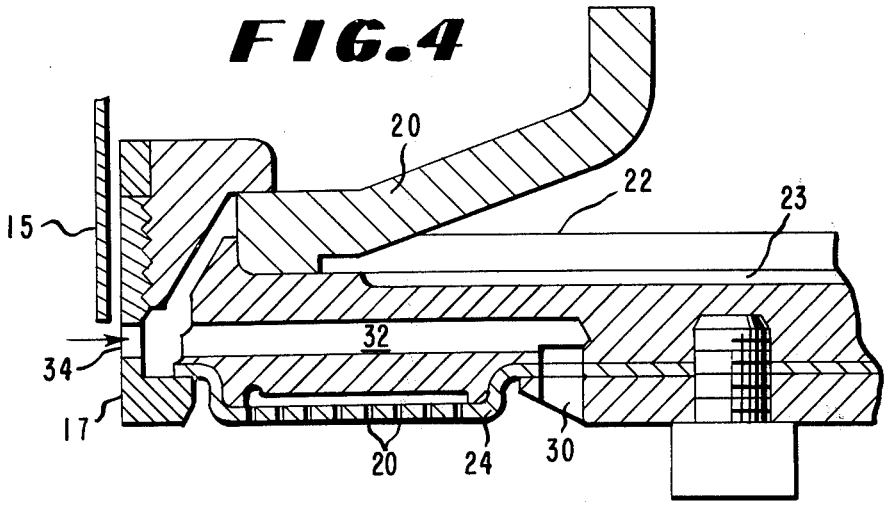
FIG. 4 is a cross-sectional side elevation of a portion of the spinning pack, taken through the line 4—4 of FIG. 3.
Figure 5:
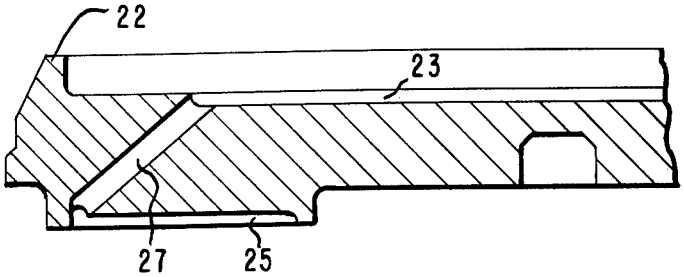
FIG. 5 is a cross-sectional side elevation of a portion of the distribution plate of the spinning pack taken along the line 5—5 of FIG. 3.

Referring now to FIG. 1, the embodiment chosen for purposes of illustration includes a housing 10 which forms a chamber 12 supplied with a heated inert gas through inlet conduit 14 which is formed in the upper portion of the sidewall 11 of the housing 10. The heated gas is uniformly distributed by a screen 13 attached to sidewall 11 below inlet conduit 14. A spinning pack 16 is positioned centrally within housing 10 and attached to a fixed inlet pipe 18 through flange connector 20 adjoining spinning pack 16 and the pipe. The inlet pipe 18 connects a source of spinning solution (not shown) to the spinning pack. A circular baffle 15 extends from the top portion of housing 10 to surround the upper portion of spinning pack 16. The baffle directs the gas flow as indicated by the arrows downwardly in the chamber and keeps it from flowing directly onto the upper portion of the spinning pack. The spinning pack 16 includes as component parts a distribution plate 22 sandwiched between spinneret 24 and flange connector 20 and held together by clamp ring 17 which is the peripheral surface of the pack. The spinneret 24 which is the bottom surface of the spinning pack 16 has a plurality of orifices 26 for extruding filaments 28 from the spinning solution supplied to the pack. As best seen in FIG. 2 the orifices 26 through which filaments 21 are extruded are arranged in concentric rings surrounding a central portion 29 of the spinneret. Within central portion 29 is a circle of holes 30 which lead to passages 32 that extend through the peripheral surface 17 of the spinning pack which is exposed to the gas in chamber 12.

The structure of spinning pack 16 which embodies the improvement of this invention is best understood by referring to FIGS. 2–5. The circular distribution plate 22 as viewed from the solution inlet is seen to include a recessed cavity 23 in its upper surface and an annular cavity 25 in its lower surface connected by passages 27 which are arranged in a circular pattern from the outside edge of cavity 23 to the outside edge of cavity 25. Interspersed in a horizontal radial fashion between passages 27 in distribution plate 22 ar passages 32 which at one end are in communication with holes 34 in the clamp ring 17 around the periphery of the pack 16 and at the other end joined to holes 30 in the central portion 29 of the spinneret.

In operation, a spinning solution is metered at a constant rate through inlet conduit 18 into spinning pack 16 where it passes through distribution plate 22 and is extruded from spinneret orifices 26 to form concentric rings of filaments 21. The constant downward motion of the large number of extruded filaments 28 creates a zone of reduced pressure in the central space within the concentric rings, and the resulting suction assists streams of hot gas in flowing through the passages 32 in the spinning pack from annular gas supply chamber 12 to the central portion 29 of the spinneret. Hot gas also flows in the normal manner through the rings of extruded filaments from the outer portion of the spinning pack to the central spade. However, because part of the gas flows directly to the central space through the passages 32 in the distribution plate 22, a constant supply of fresh heated gas which contains no evaporated spinning solvent is provided to the innermost rings of extruded filaments.

Thus by distributing some of the hot gas from chamber 12 directly to the center of the spinneret through the passages 32 in the spinning pack a smaller amount of the hot gas flows through the outermost filaments and the distribution of the hot gas is more uniform resulting in a spinning operation of increased continuity.

We claim:

1. In an apparatus for spinning filaments that includes a spinning pack located in a chamber supplied with gas for impinging against and flowing through filaments extruded in a downward direction from the bottom surface of said spinning pack in concentric rings surrounding a central portion of said bottom surface, said spinning pack having a peripheral surface exposed to the gas in said chamber, the improvement comprising: a passage connecting said peripheral surface and said central portion of said bottom surface to provide a flow passage through said spinning pack for said gas, whereby a portion of the gas is aspirated from said chamber through said passage downwardly to the central portion of said bottom surface for impinging the innermost of said concentric rings as such filaments are being extruded.

2. The apparatus as defined in claim 1, there being a plurality of said passages extending radially from a circular pattern of holes in said central portion.

3. The apparatus as defined in claim 2, said passages being equispaced radially.

* * * * *